US011105483B2

(12) United States Patent
Uchida et al.

(10) Patent No.: US 11,105,483 B2
(45) Date of Patent: Aug. 31, 2021

(54) VEHICLE LAMP

(71) Applicant: KOITO MANUFACTURING CO., LTD., Tokyo (JP)

(72) Inventors: Naoki Uchida, Shizuoka (JP); Honami Fujii, Shizuoka (JP); Masanori Kito, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/980,718

(22) PCT Filed: Mar. 13, 2019

(86) PCT No.: PCT/JP2019/010361
§ 371 (c)(1),
(2) Date: Sep. 14, 2020

(87) PCT Pub. No.: WO2019/177051
PCT Pub. Date: Sep. 19, 2019

(65) Prior Publication Data

US 2021/0025559 A1 Jan. 28, 2021

(30) Foreign Application Priority Data

Mar. 15, 2018 (JP) ..... JP2018-048658

(51) Int. Cl.
*F21S 41/20* (2018.01)
*F21S 41/25* (2018.01)
(Continued)

(52) U.S. Cl.
CPC ..... *F21S 41/285* (2018.01); *F21S 41/16* (2018.01); *F21S 41/25* (2018.01); *F21S 41/43* (2018.01);
(Continued)

(58) Field of Classification Search
CPC ..... F21S 41/16; F21S 41/28; F21S 41/285; F21S 41/43; F21S 41/42; F21S 41/47;
(Continued)

(56) References Cited

U.S. PATENT DOCUMENTS

2003/0223246 A1 12/2003 Albou
2012/0212933 A1 8/2012 Toko
(Continued)

FOREIGN PATENT DOCUMENTS

JP 2004-47461 A 2/2004
JP 2012-146621 A 8/2012
(Continued)

OTHER PUBLICATIONS

English Machine Translation of JP2016176996 provided by ESPACENET (Year: 2016).*
(Continued)

*Primary Examiner* — Zheng Song
(74) *Attorney, Agent, or Firm* — Sughrue Mion, PLLC

(57) ABSTRACT

A vehicle lamp is provided with a light source (51) that emits light in a predetermined wavelength band, a diffractive optical element (53) that diffracts the light emitted from the light source (51) to have a predetermined light distribution pattern, and a shade (55) that shields, of the light forming the predetermined light distribution pattern, at least part of the light forming the outer peripheral portion of the predetermined light distribution pattern, and the shade (55) shields the light forming the outer peripheral portion of the predetermined light distribution pattern over the entire circumference of the light distribution pattern.

4 Claims, 2 Drawing Sheets

(51) Int. Cl.

| | |
|---|---|
| ***F21S 41/63*** | (2018.01) |
| ***F21S 41/16*** | (2018.01) |
| ***F21S 45/42*** | (2018.01) |
| ***F21S 41/43*** | (2018.01) |
| ***F21S 45/47*** | (2018.01) |

(52) U.S. Cl.
CPC ..... *F21S 41/63* (2018.01); *F21S 45/42* (2018.01); *F21S 45/47* (2018.01)

(58) Field of Classification Search
CPC .. F21S 41/63; F21S 41/25; F21S 41/68; F21S 45/42; F21S 45/43; F21S 45/47; F21V 5/04; F21V 9/14
See application file for complete search history.

(56) References Cited

U.S. PATENT DOCUMENTS

| | | | | |
|---|---|---|---|---|
| 2013/0250381 | A1 | 9/2013 | Toko et al. | |
| 2019/0078749 | A1* | 3/2019 | Toko | G02B 27/283 |
| 2019/0257493 | A1* | 8/2019 | Sugiyama | F21S 41/143 |
| 2019/0390836 | A1* | 12/2019 | Hirata | F21S 41/141 |
| 2020/0200351 | A1* | 6/2020 | Kogure | F21S 41/321 |
| 2020/0217472 | A1* | 7/2020 | Toko | F21S 41/285 |

FOREIGN PATENT DOCUMENTS

| | | | |
|---|---|---|---|
| JP | 2012-174520 | A | 9/2012 |
| JP | 2013-174520 | A | 9/2012 |
| JP | 2013-196957 | A | 9/2013 |
| JP | 2016-176996 | A | 10/2016 |
| JP | 2017-50256 | A | 3/2017 |
| JP | 2017-191745 | A | 10/2017 |
| WO | 2017/013860 | A1 | 1/2017 |

OTHER PUBLICATIONS

International Search Report for PCT/JP2019/010361 dated May 14, 2019.

* cited by examiner

VEHICLE LAMP

CROSS REFERENCE TO RELATED APPLICATIONS

This application is a National Stage of International Application No. PCT/JP2019/010361 filed Mar. 13, 2019, claiming priority based on Japanese Patent Application No. 2018-048658 filed Mar. 15, 2018.

TECHNICAL FIELD

The present invention relates to a vehicle lamp, and more particularly to a vehicle lamp capable of suppressing color bleeding of emitted light.

BACKGROUND ART

Examples of a vehicle lamp include a vehicle headlamp typified by an automobile headlight. A vehicle headlamp is configured to emit at least a low beam for illuminating the front at night. In order to form a light distribution pattern of the low beam, a shade that shields a part of light emitted from a light source is used.

Patent Literature 1 set out below discloses a vehicle headlamp including a hologram element and a light source that irradiates the hologram element with reference light. The hologram element is calculated in such a manner that diffracted light, which is reproduced by being irradiated with the reference light, forms a low-beam light distribution pattern. It is said that this vehicle headlamp does not require a shade and can be downsized as the low-beam light distribution pattern is formed by the hologram element as described above.

[Patent Literature 1] JP 2012-146621 A

SUMMARY OF INVENTION

White reference light is made incident on the hologram element of the vehicle headlamp of Patent Literature 1 mentioned above from a light source, and diffracted light thereof forms the low-beam light distribution pattern. White light is light that is a composite of light of a plurality of wavelengths. Meanwhile, a hologram element, which is a kind of diffraction grating, has wavelength dependence. Therefore, beams of light of different wavelengths included in the white light tend to have different light distribution patterns due to the hologram element. Accordingly, in a case where the vehicle headlamp disclosed in Patent Literature 1 mentioned above emits a low beam, light bleeding in which different colors of light come out tends to occur in the vicinity of the edge of the low-beam light distribution pattern.

In view of the above, it is an object of the present invention to provide a vehicle lamp capable of suppressing color bleeding of emitted light.

In order to achieve the object mentioned above, a vehicle lamp according to the present invention includes a light source that emits light in a predetermined wavelength band, a diffractive optical element that diffracts the light emitted from the light source to have a predetermined light distribution pattern, and a shade that shields, of the light forming the predetermined light distribution pattern, at least a part of the light forming an outer peripheral portion of the predetermined light distribution pattern.

Since the diffraction grating generally has wavelength dependence in the diffraction direction as described above, in a case where the diffractive optical element diffracts light to have a predetermined light distribution pattern, light of a plurality of wavelengths is easily combined near the center of the light distribution pattern, and the wavelength band of light is easily widened. Meanwhile, the wavelength band of light tends to be narrower in the outer peripheral portion of the light distribution pattern, and color bleeding of the light tends to occur as described above. In the vehicle lamp according to the present invention, the shade shields at least a part of the light forming the outer peripheral portion of the predetermined light distribution pattern formed by the diffracted light emitted from the diffractive optical element. Therefore, at least a part of the light that causes the color bleeding of the light as described above is shielded by the shade, and the vehicle lamp according to the present invention can suppress the color bleeding of the emitted light.

Furthermore, the shade preferably shields the light forming the outer peripheral portion of the predetermined light distribution pattern over the entire circumference of the light distribution pattern.

With the shade shielding the light over the entire circumference of the light distribution pattern, color bleeding of the light can be suppressed over the entire circumference of the light distribution pattern.

Furthermore, the diffractive optical element is preferably capable of changing the predetermined light distribution pattern.

Since the diffractive optical element can change the light distribution pattern formed by the diffracted light, a plurality of light distribution patterns can be formed by one vehicle lamp.

Furthermore, the shade preferably has a structure in which a position of shielding light emitted from the diffractive optical element changes according to a change of the predetermined light distribution pattern.

When the light distribution pattern formed by the diffracted light emitted from the diffractive optical element changes, the position at which, of the light emitted from the diffractive optical element, light in a narrow wavelength band is generated may change. As described above, of the light emitted from the diffractive optical element, the light to be shielded by the shade changes according to the change of the light distribution pattern, whereby, even in a case where the position at which the light in a narrow wavelength band is generated changes, the light in the narrow wavelength band can be shielded by the shade. Therefore, color bleeding of the light emitted from the vehicle lamp can be suppressed before and after the change of the light distribution pattern.

Furthermore, the shade is preferably provided at a position where the light emitted from the diffractive optical element forms an image.

With the shade provided at the position where the light emitted from the diffractive optical element forms an image, it becomes possible to easily design the shade that shields the light emitted from the diffractive optical element having a narrow wavelength band.

Furthermore, a Fourier transform lens is preferably provided between the diffractive optical element and the shade.

With the Fourier transform lens provided, the imaging position by the light emitted from the diffractive optical element can be brought closer to the side of the diffractive optical element compared with the case without the Fourier transform lens. Therefore, the distance between the diffractive optical element and the shade can be reduced, and the vehicle lamp can be downsized.

As described above, according to the present invention, a vehicle lamp capable of suppressing color bleeding of emitted light can be achieved.

DESCRIPTION OF EMBODIMENTS

Hereinafter, an embodiment of a vehicle lamp according to the present invention will be exemplified with reference to the accompanying drawings. The embodiment exemplified below is for the purpose of facilitating the understanding of the present invention, and is not for limiting the interpretation of the present invention. The present invention can be modified and improved from the embodiment below without departing from the gist thereof.

First, a configuration of a vehicle lamp according to the present embodiment will be described.

Figure 1:
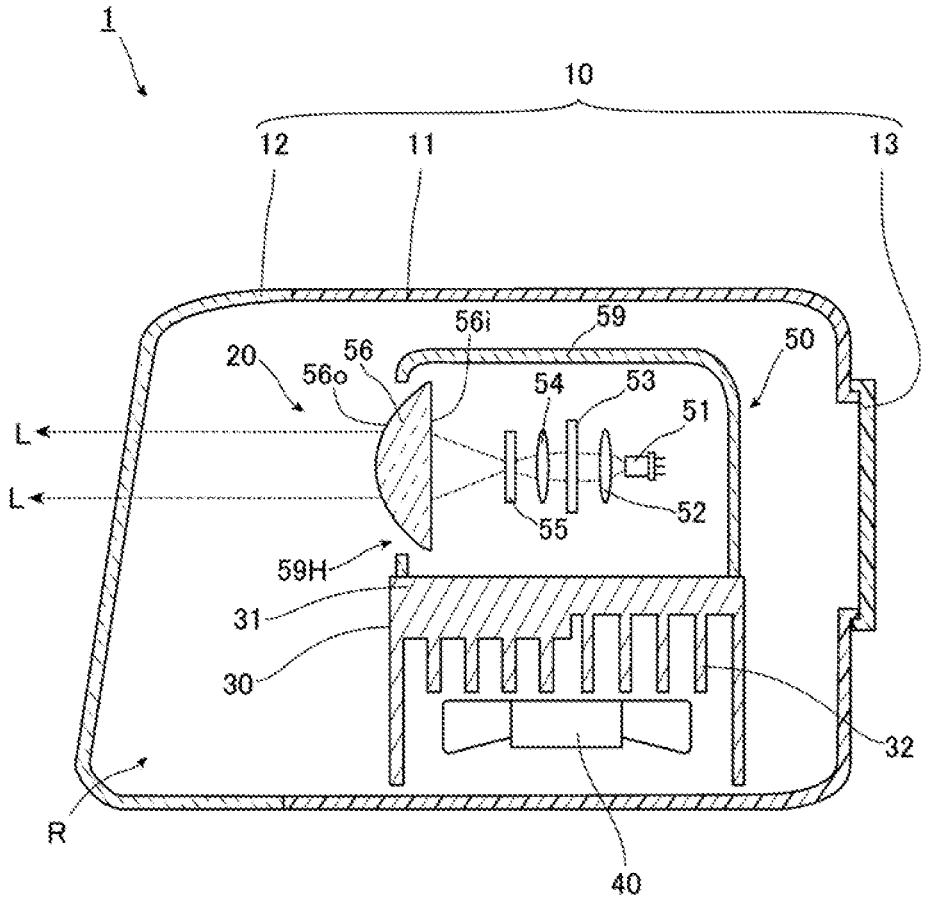
FIG. 1 is a cross-sectional view schematically illustrating a vehicle including a vehicle lamp according to an embodiment of the present invention.

FIG. 1 is a cross-sectional view schematically illustrating a vehicle including the vehicle lamp according to the present embodiment. The vehicle lamp according to the present embodiment is a vehicle headlamp 1, and includes a case 10 and a lamp unit 20.

The case 10 includes a lamp housing 11, a front cover 12, and a back cover 13 as main components. The front of the lamp housing 11 is open, and the front cover 12 is fixed to the lamp housing 11 to close the opening. Further, an opening smaller than that in the front is formed in the rear of the lamp housing 11, and the back cover 13 is fixed to the lamp housing 11 to close the opening.

The space formed by the lamp housing 11, the front cover 12 that closes the front opening of the lamp housing 11, and the back cover 13 that closes the rear opening of the lamp housing 11 serves as a lamp room R, and the lamp room R houses the lamp unit 20 inside thereof.

The lamp unit 20 includes a heatsink 30, a cooling fan 40, and an optical system unit 50 as main components. Note that the lamp unit 20 is fixed to the case 10 by a configuration not illustrated.

The heatsink 30 includes a metal base plate 31 extending in a substantially horizontal direction, and a plurality of heat dissipation fins 32 is integrally provided with the base plate 31 on the lower surface side of the base plate 31. The cooling fan 40 is disposed to face the heat dissipation fins 32 with a gap interposed therebetween, and is fixed to the heatsink 30. The heatsink 30 is cooled by the air flow generated by the rotation of the cooling fan 40.

The optical system unit 50 is disposed on the upper surface of the base plate 31 of the heatsink 30. The optical system unit 50 includes a light source 51, a collimator lens 52, a diffractive optical element 53, a Fourier transform lens 54, a shade 55, a projection lens 56, and a cover 59.

The light source 51 emits light in a predetermined wavelength band. That is, the light source 51 emits light of a plurality of wavelengths. The light emitted from the light source 51 is applied to the diffractive optical element 53. A type of the light source that can be used as such a light source 51 is not particularly limited, and for example, a laser oscillation apparatus that emits white light can be used as the light source 51. Note that the light source 51 may have a structure that combines the light emitted from a plurality of light sources. For example, the light source may synthesize monochromatic light emitted from a plurality of light sources to emit white light.

Further, the optical system unit 50 includes a circuit board (not illustrated), the light source 51 is mounted on the circuit board, and power is supplied to the light source 51 via the circuit board.

The collimator lens 52 is a lens that collimates light emitted from the light source 51 in the fast axis direction and the slow axis direction. A collimator lens that collimates the fast axis direction of light and a collimator lens that collimates the slow axis direction may be provided separately.

The diffractive optical element 53 diffracts light emitted from the collimator lens 52 to have a predetermined light distribution pattern. The diffractive optical element according to the present embodiment diffracts light incident from the collimator lens 52 in such a manner that light emitted from the light source 51 has a low-beam light distribution pattern. This light distribution pattern also includes a luminous intensity distribution. Accordingly, the diffractive optical element 53 according to the present embodiment diffracts the light incident from the collimator lens 52 in such a manner that laser light emitted from the diffractive optical element 53 has a shape substantially similar to the outer shape of the light distribution pattern of a low beam L and has a luminous intensity distribution based on the luminous intensity distribution of the light distribution pattern of the low beam L. In this manner, light to form the light distribution pattern of the low beam L is emitted from the diffractive optical element 53. However, in the vehicle headlamp 1 according to the present embodiment, the low beam L is emitted through the projection lens 56 as described later, whereby the light distribution pattern formed by the diffractive optical element 53 is vertically inverted with respect to the light distribution pattern of the low beam L emitted from the vehicle headlamp 1.

The Fourier transform lens 54 is a convex lens provided between the diffractive optical element 53 and the shade 55. With the Fourier transform lens 54 provided in this manner, the imaging position by the light emitted from the diffractive optical element 53 can be brought closer to the side of the diffractive optical element 53 compared with the case without the Fourier transform lens 54. Therefore, the distance between the diffractive optical element 53 and the shade 55 can be reduced, and the vehicle headlamp 1 can be downsized.

The shade 55 is disposed between the diffractive optical element 53 and the projection lens 56. In addition, the shade 55 shields at least a part of the light forming the outer peripheral portion of the predetermined light distribution pattern formed by the diffracted light emitted from the diffractive optical element 53. The shade 55 according to the present embodiment shields the light forming the outer peripheral portion of the predetermined light distribution pattern, which is formed by the diffracted light emitted from the diffractive optical element 53, over the entire circumference of the light distribution pattern.

Furthermore, the shade 55 according to the present embodiment shields, in the outer peripheral portion of the light distribution pattern, a region irradiated with only light of a part of the predetermined wavelength band among the light that is emitted from the light source 51 and that has the wavelength band. For example, in a case where the light to be emitted from the vehicle headlamp 1 is desired to be white light, the light to be emitted from the light source 51 is set to white light, and the shade 55 shields a region irradiated with only light of some wavelengths such as red, blue, and green, which is a part of the wavelength band of light forming the white light.

Figure 2:
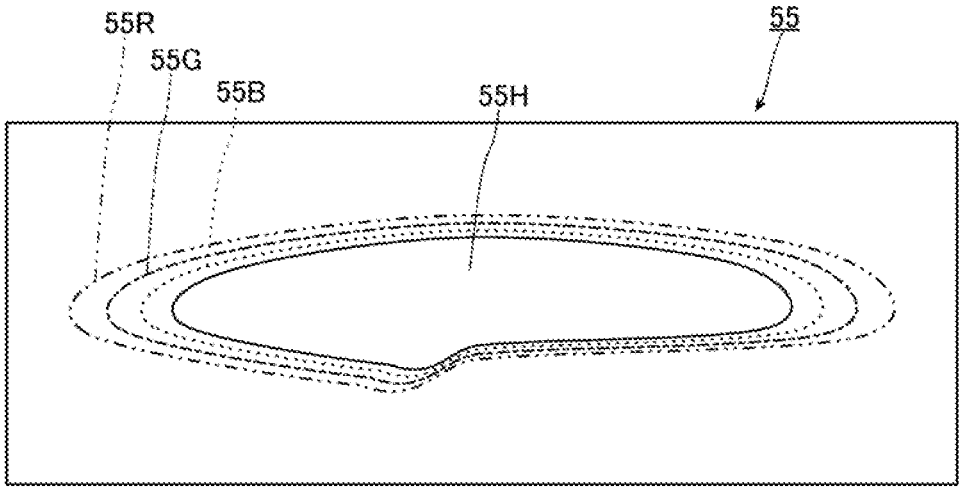
FIG. 2 is a schematic view of a shade illustrated in FIG. 1 viewed from the side of a diffractive optical element.

FIG. 2 is a schematic view of the shade 55 illustrated in FIG. 1 viewed from the side of the diffractive optical element 53. The shade 55 is a plate body having an opening 55H at the center. The opening 55H in the present embodiment is formed in a shape vertically inverted with respect to the light distribution pattern of the low beam L. With the shade 55 formed in this manner, as will be described below, the shade 55 shields a part of the light emitted from the diffractive optical element 53, and another part of the light passes through the opening 55H to be incident on the projection lens 56.

Of the light diffracted by the diffractive optical element 53, light having a long wavelength tends to spread easily. Accordingly, in a case where the light source 51 emits white light, as illustrated in FIG. 2, the red light is applied to a region 55R indicated by a chain double-dashed line, the green light is applied to a region 55G indicated by a chain line, and the blue light is applied to a region 55B indicated by a dotted line, for example. In this manner, the shade 55 shields the red light, the green light, and the blue light. Meanwhile, a part of the white light is shielded by the shade 55, and another part is transmitted through the opening 55H. That is, the shade 55 according to the present embodiment also shields a part of the region irradiated with light in the wavelength band same as the wavelength band of the light emitted by the light source 51.

Furthermore, the shade 55 according to the present embodiment is provided at a position where the light emitted from the diffractive optical element 53 forms an image. That is, since the Fourier transform lens 54 is provided in the present embodiment, the shade 55 is provided at the focal position of the Fourier transform lens 54.

The projection lens 56 is an aspherical plano-convex lens, an incident surface 56*i* that is a surface on the side on which the light emitted from the diffractive optical element 53 is made incident is planar, and an emission surface 56*o* that is a surface on the side on which the light is emitted is convex bulging toward the side of the light emission direction. Such a projection lens 56 projects, as an inverted image, a light source image formed on the rear focal plane that is a focal plane including the rear focal point. Therefore, the imaging position by the diffracted light from the diffractive optical element 53 or the vicinity of the imaging position overlaps with the rear focal plane of the projection lens 56, whereby the light of the light distribution pattern formed at the imaging position is inverted and projected from the projection lens 56. Since the shade 55 is provided at the imaging position of the light from the diffractive optical element 53 in the present embodiment as described above, the shade 55 in the present embodiment is provided on the rear focal plane or in the vicinity of the rear focal plane of the projection lens 56.

The cover 59 is fixed on the base plate 31 of the heatsink 30. The cover 59 has a substantially rectangular shape, and is made of a metal such as aluminum. The light source 51, the collimator lens 52, the diffractive optical element 53, the Fourier transform lens 54, the shade 55, and the projection lens 56 are disposed in the space inside the cover 59. However, an opening 59H is formed in the front of the cover 59, and the emission surface 56*o* of the projection lens 56 is exposed at the opening 59H. Note that the inner wall of the cover 59 is preferably made light absorptive by black alumite processing or the like. With the inner wall of the cover 59 made light absorptive, it becomes possible to suppress the phenomenon that the light emitted to the inner wall of the cover 59 due to unintended reflection, refraction, or the like is reflected and then emitted from the opening 59H in an unintended direction.

Next, light emission by the vehicle headlamp 1 will be described.

First, when power is supplied from a power source (not illustrated), the light source 51 emits light. This light is collimated by the collimator lens 52, and then incident on the diffractive optical element 53. Then, the light incident on the diffractive optical element 53 is diffracted such that a predetermined light distribution pattern is formed, and is emitted to the side of the shade 55 via the Fourier transform lens 54. The shade 55 shields, of the light emitted from the diffractive optical element 53, at least a part of the light forming the outer peripheral portion of the predetermined light distribution pattern. At least a part of the light not shielded by the shade 55 is made incident on the projection lens 56, passes through the projection lens 56 and the front cover 12, and is emitted toward the outside of the vehicle headlamp 1. Note that the light distribution pattern formed by the diffractive optical element 53 has an outer shape that is substantially similar to the outer shape of the low beam L and is vertically inverted, and the light emitted from the projection lens 56 has the light distribution pattern of the low beam L.

Figure 3A:
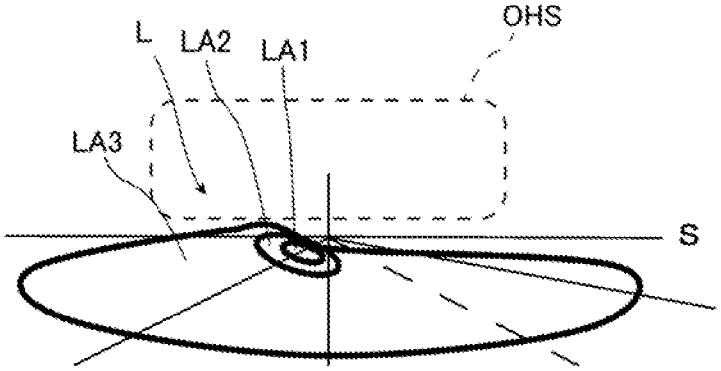
FIG. 3A and FIG. 3B are diagrams illustrating a light distribution pattern.
Figure 3B:
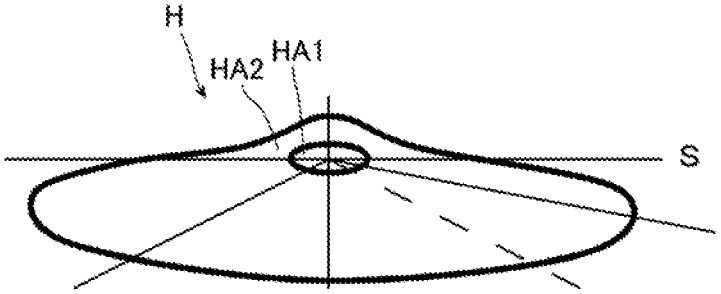

FIG. 3A and FIG. 3B are diagrams illustrating a light distribution pattern for night illumination, specifically, FIG. 3A is a diagram illustrating a low-beam light distribution pattern, and FIG. 3B is a diagram illustrating a high-beam light distribution pattern. In FIG. 3A and FIG. 3B, S indicates a horizontal line, and the light distribution pattern is indicated by a thick line. In the light distribution pattern of the low beam L, which is the light distribution pattern for night illumination illustrated in FIG. 3A, an area LA1 is an area where luminous intensity is the highest, and the luminous intensity decreases in the order of an area LA2 and an area LA3. That is, the diffractive optical element 53 diffracts the light emitted from the light source 51 to form a light distribution pattern including a luminous intensity distribution of the low beam L. Note that, as indicated by a broken line in FIG. 3A, the vehicle headlamp 1 may emit light whose luminous intensity is lower than the low beam L above the position irradiated with the low beam L. This light is used as light OHS for visually recognizing a sign. In this case, the diffracted light emitted from the diffractive optical element 53 preferably includes the light OHS for visually recognizing a sign. Furthermore, in this case, it can be understood that the low beam L and the light OHS for visually recognizing a sign form a light distribution pattern for night illumination. Note that the light distribution pattern for night illumination is not only used at night, but also in a dark place such as a tunnel.

As described above, the vehicle headlamp 1 according to the present embodiment includes the light source 51 that emits light in a predetermined wavelength band, the diffractive optical element 53 that diffracts the light emitted from the light source 51 to have a predetermined light distribution pattern, and the shade 55 that shields, of the light forming the light distribution pattern, at least a part of the light forming the outer peripheral portion of the light distribution pattern.

Since the diffraction grating generally has wavelength dependence in the diffraction direction as described above, in a case where the diffractive optical element 53 diffracts light to have a predetermined light distribution pattern, light of a plurality of wavelengths is easily combined near the center of the light distribution pattern, and the wavelength band of light is easily widened. Meanwhile, the wavelength band of light tends to be narrower in the outer peripheral portion of the light distribution pattern, and color bleeding of the light tends to occur as described above. In the vehicle headlamp 1 according to the present embodiment, the shade 55 shields at least a part of the light forming the outer peripheral portion of the predetermined light distribution pattern formed by the diffracted light emitted from the diffractive optical element 53. Therefore, at least a part of the light that causes the color bleeding of light as described above is shielded by the shade 55, and the vehicle headlamp 1 according to the present embodiment can suppress the color bleeding of the emitted light.

Furthermore, the shade 55 according to the present embodiment shields the light forming the outer peripheral portion of the predetermined light distribution pattern, which is formed by the diffracted light emitted from the diffractive optical element 53, over the entire circumference of the light distribution pattern. Therefore, the color bleeding of light can be suppressed over the entire circumference of the light distribution pattern.

Furthermore, the shade 55 according to the present embodiment is provided at a position where the light emitted from the diffractive optical element 53 forms an image. With the shade 55 provided at the position where the light emitted from the diffractive optical element 53 forms an image, it becomes possible to easily design the shade 55 that shields the light emitted from the diffractive optical element 53 having a narrow wavelength band.

Furthermore, in the vehicle headlamp 1 according to the present embodiment, the light source 51, the diffractive optical element 53, and the projection lens 56 are linearly disposed. Therefore, occurrence of an optical path difference is suppressed in the light forming the predetermined light distribution pattern, and the desired light distribution pattern can be easily formed.

Although the present invention has been described using the embodiment as an example, the present invention is not limited thereto.

For example, while the vehicle headlamp 1 that emits the low beam L has been exemplified in the embodiment described above, the vehicle lamp according to the present invention may emit a high beam H. In that case, light of the light distribution pattern of the high beam H, which is the light distribution pattern for night illumination illustrated in FIG. 3B, is emitted. Note that, in the light distribution pattern of the high beam H in FIG. 3B, an area HA1 is an area where luminous intensity is the highest, and an area HA2 is an area where luminous intensity is lower than that of the area HA1. That is, the diffractive optical element 53 diffracts the light emitted from the light source 51 to form a light distribution pattern including a luminous intensity distribution of the high beam H.

Furthermore, in the embodiment described above, an exemplary case where the light distribution pattern formed by imaging the diffracted light emitted from the diffractive optical element 53 is one predetermined light distribution pattern has been described. However, the diffractive optical element 53 may freely change the light distribution pattern formed by the diffracted light. That is, the diffractive optical element 53 may be capable of changing the light distribution pattern. Such a diffractive optical element 53 includes, for example, a Si substrate whose surface has a plurality of pixel electrodes each of whose potentials is independently controlled, a transparent electrode, and a liquid crystal layer sandwiched between the pixel electrode and the transparent electrode. In this case, the potentials of the plurality of pixel electrodes are independently controlled, whereby the light distribution pattern formed by imaging the diffracted light emitted from the diffractive optical element 53 can be freely changed. Since the diffractive optical element 53 can change the light distribution pattern formed by the diffracted light in this manner, a plurality of light distribution patterns can be formed by one vehicle headlamp 1. For example, one vehicle headlamp 1 can form the light distribution pattern of the low beam L and the light distribution pattern of the high beam H.

Furthermore, the shade 55 according to the embodiment described above shields all areas irradiated with only the light, whose wavelength band is narrower than the wavelength band of the light emitted by the light source 51, among the light emitted from the diffractive optical element 53. However, it is sufficient if the shade 55 shields at least a part of the light forming the outer peripheral portion of the predetermined light distribution pattern formed by the diffracted light emitted from the diffractive optical element 53. Therefore, for example, it is sufficient if the shade 55 shields at least a part of the light, whose wavelength band is narrower than the predetermined wavelength band of the light emitted by the light source 51, among the light emitted from the diffractive optical element 53. That is, it is sufficient if the shade 55 shields at least a part of the area irradiated with only the light, whose wavelength band is narrower than the wavelength band of the light emitted by the light source 51, among the light emitted from the diffractive optical element 53. In this case, another part of the area irradiated with only the light, whose wavelength band is narrower than the wavelength band of the light emitted by the light source 51, is not necessarily shielded by the shade 55. For example, in a case where the light source 51 emits white light, the shade 55 shields the outermost area which belongs to the light distribution pattern formed by the light emitted from the diffractive optical element 53 and is irradiated with only red light, and the shade 55 does not necessarily shield the area of the light distribution pattern which is inner than the outermost area and is irradiated with only blue light.

Furthermore, in a case where the diffractive optical element 53 can change the light distribution pattern as described above, the shade 55 preferably has a structure in which the position of shielding the light emitted from the diffractive optical element 53 changes according to the change of the light distribution pattern. Such a shade 55 is composed of, for example, a liquid crystal shutter. When the light distribution pattern formed by the light emitted from the diffractive optical element 53 changes, the position at which, of the light emitted from the diffractive optical element 53, light in a narrow wavelength band is generated may change. As described above, of the light emitted from the diffractive optical element 53, the light to be shielded by the shade 55 changes according to the change of the light distribution pattern, whereby, even in a case where the position at which the light in a narrow wavelength band is generated changes, the light in the narrow wavelength band can be shielded by the shade 55. Therefore, color bleeding of light emitted from the vehicle headlamp 1 can be suppressed before and after the change of the light distribution pattern.

Furthermore, while an exemplary case where the light source 51, the diffractive optical element 53, and the projection lens 56 are linearly disposed has been described in the embodiment above, the light source 51, the diffractive optical element 53, and the projection lens 56 may be disposed in a non-linear manner. For example, the light source 51, the diffractive optical element 53, and the projection lens 56 may be disposed in a non-linear manner, and the diffractive optical element 53 may be configured to refract or reflect the light from the light source 51 so that the light is emitted toward the side of the projection lens 56.

Furthermore, the vehicle lamp according to the present invention is not limited to the vehicle headlamp, and may be, for example, a drawing lamp that displays characters, figures, and the like outside the vehicle.

Furthermore, while an exemplary case where the light source 51 emits white light has been described in the embodiment above, the color of light to be emitted from the light source 51 is not particularly limited. As described above, the vehicle lamp according to the present invention is not limited to the vehicle headlamp and may be a drawing lamp or the like, and in a case where the vehicle lamp according to the present invention is set to a drawing lamp or the like, the light to be emitted from the vehicle lamp according to the present invention does not have to be white light. The color of the light to be emitted from the light source 51 can be selected according to the color of the light desired to be emitted from the vehicle lamp according to the present invention. However, in a case where light in a wide wavelength band, such as white light, is emitted from the light source 51, the effect of suppressing color bleeding of the light may be more remarkable.

According to the present invention, there is provided a vehicle lamp capable of suppressing color bleeding of emitted light, which can be used in the field of vehicle headlamps for automobiles and the like.

REFERENCE SIGNS LIST

1 . . . vehicle headlamp
10 . . . case
20 . . . lamp unit
30 . . . heatsink
40 . . . cooling fan
51 . . . light source
53 . . . diffractive optical element
54 . . . Fourier transform lens
55 . . . shade
56 . . . projection lens

The invention claimed is:

1. A vehicle lamp comprising:

a light source that emits light in a predetermined wavelength band;

a diffractive optical element that diffracts the light emitted from the light source to have a predetermined light distribution pattern; and a shade that shields, of the light forming the predetermined light distribution pattern, at least a part of the light forming an outer peripheral portion of the predetermined light distribution pattern;

wherein the diffractive optical element can change the predetermined light distribution pattern, and wherein the shade has a structure in which a position of shielding light emitted from the diffractive optical element changes according to a change of the predetermined light distribution pattern.

2. The vehicle lamp according to claim 1, wherein the shade shields the light forming the outer peripheral portion of the predetermined light distribution pattern over an entire circumference of the light distribution pattern.

3. The vehicle lamp according to claim 1, wherein the shade is provided at a position where the light emitted from the diffractive optical element forms an image.

4. The vehicle lamp according to claim 1, wherein a Fourier transform lens is provided between the diffractive optical element and the shade.

* * * * *